US005155669A

United States Patent [19]

Yamuro

[11] Patent Number: 5,155,669

[45] Date of Patent: Oct. 13, 1992

[54] LIGHT EMITTING APPARATUS

[76] Inventor: Yukio Yamuro, 5-2-302 Shirokane 2-chome, Minato-ku Tokyo, Japan

[21] Appl. No.: 424,178

[22] Filed: Oct. 19, 1989

Related U.S. Application Data

[63] Continuation of Ser. No. 205,327, May 24, 1988, abandoned.

[30] Foreign Application Priority Data

May 20, 1987 [JP] Japan ..... 62-75686[U]

[51] Int. Cl.[5] ..... F21P 1/00

[52] U.S. Cl. ..... 362/252; 362/249; 362/800

[58] Field of Search ..... 362/249, 250, 251, 800, 362/806, 252; 315/185 S, 185 R, 186

[56] References Cited

U.S. PATENT DOCUMENTS

| | | | |
|---|---|---|---|
| 3,214,579 | 10/1965 | Pacini | 362/227 |
| 3,500,036 | 6/1966 | Szentveri | 362/249 |
| 3,770,951 | 11/1973 | Corelli et al. | 362/249 |
| 3,789,211 | 1/1974 | Kramer | 315/185 S |
| 4,107,767 | 8/1978 | Anquetin | 362/252 |
| 4,173,035 | 10/1979 | Hoyt | 362/806 |
| 4,204,273 | 5/1980 | Goldberg | 362/249 |
| 4,282,562 | 8/1981 | Marino | 362/202 |
| 4,439,818 | 3/1984 | Scheib | 362/800 |
| 4,516,193 | 5/1985 | Murphy | 362/123 |
| 4,521,835 | 6/1985 | Meggs et al. | 362/251 |
| 4,682,079 | 7/1987 | Sanders et al. | 315/186 |
| 4,761,720 | 8/1988 | Solow | 362/800 |
| 4,774,642 | 9/1988 | Janko et al. | 362/800 |
| 4,779,177 | 10/1988 | Ahroni | 362/249 |
| 4,812,953 | 3/1989 | Ask et al. | 362/251 |
| 4,839,777 | 6/1989 | Janko et al. | 362/806 |
| 4,939,426 | 7/1990 | Menard et al. | 315/185 R |

FOREIGN PATENT DOCUMENTS

| | | | |
|---|---|---|---|
| 51-87974 | 7/1976 | Japan | 362/800 |
| 54-49189 | 4/1979 | Japan | 362/800 |
| 55-61901 | 4/1980 | Japan | 362/800 |
| 59-02902 | 3/1984 | Japan | 362/800 |
| 59-215602 | 12/1984 | Japan . | |

*Primary Examiner*—Stephen F. Husar

*Attorney, Agent, or Firm*—Sandler, Greenblum & Bernstein

[57] ABSTRACT

An apparatus is disclosed that includes a plurality of conductors arranged in parallel, and a plurality of multi-light emitting diodes. One terminal of each of the multi-light emitting diodes is conected to one of the conductors, and the other terminal of each is connected to another conductor. The multi-light emitting diodes include a plurality of light emitting diodes which are connected in series or in parallel and are molded integrally, and are spaced at intervals in the longitudinal direction of the conductors. A flexible insulator covers the conductive portions of the multi-light emitting diodes. The conductors enable an electric current to pass to the multi-light emitting diodes to emit light. The apparatus is very flexible and compact, and can be powered by a portable power source.

7 Claims, 3 Drawing Sheets

LIGHT EMITTING APPARATUS

This is a continuation of application Ser. No. 07/205,327 filed May 24, 1988, now abandoned.

APPLICATION FIELD IN INDUSTRY

The present device relates to an electric ornament or display, outside or inside a building.

PRIOR ART

Conventionally, a light emitting apparatus having a light emitting element is attached to a tape-like conductive wire as shown in FIG. 10. In FIG. 10, 5 is a light emitting apparatus, 3 an insulating material, 4 a tape-shaped conductor, 6 a light emitting tube, and 7 a socket. A neon lamp or white-heat filament electric bulb is used for the light-emitting tube bulb 6. A circuit utilizing a neon lamp is shown in FIG. 11, in which 8 is an exteriorly attached resistor, 9 a neon lamp, and 9-1 an electric bulb. A circuit comprising white-heat filament electric bulb is shown in FIG. 12, in which 10 is an electric bulb and 10-1 is a filament.

When electric power is connected to the tape-shaped conductor 4, a light emitting tube bulb 6 such as a neon lamp or white heat filament electric bulb becomes conductive, thereby emitting light.

Such a light emitting apparatus is attached to a building or a product such as a Christmas tree.

The above conventional light emitting apparatus has a number of defects which greatly limit the places where it can be installed. The industrial field or device to which the prior art light emitting apparatus is applied is very much limited. The present invention intends to solve the problem and provide a light emitting apparatus which has broad application.

The first defect of the prior art light emitting apparatus is its fragility and short life. The light emitting element of the light emitting apparatus 5 is made of glass which is easily broken, and it has a relatively short life due to bad discharge conditions and filament breakage. Therefore maintenance required for changing the tube or bulb is very troublesome.

The second defect is that the height from the surface of the conductor tape to the top of light emitting tube or bulb 6 is large and the light emitting apparatus is bulky. FIG. 13 shows a side view of a portion to which a light emitting element is attached. In order to attach light emitting tube or bulb 6 as a light emitting element, the socket 7 is first attached to tape-shape electric wire and the light emitting tube bulb 6 is attached to the socket 7. The height H is usually up to 1 cm when it is attached. In FIG. 13, 7-1 is a terminal of the socket 7.

The third defect is that a dry cell cannot be used as the power source. Where the light emitting tube bulb is a neon lamp, voltage of at least 15–16 V is needed for light emission. Therefore, a cell cannot provide sufficient voltage. A white heat filament electric bulb has a large current capacity which rapidly consumes power, making a cell impractical. A white heat filament electric bulb thus requires a large electric power source such as a commercial power source (100 V, 220 V).

Due to the above defect, it has the disadvantage that locations where such a power source is available are limited to a place in which a large power source such as a commercial power source can be used. As it is made of glass and is easily broken, it cannot be used in locations or application where mechanical vibrations and shock are severe, even if a large power source is available.

MEANS FOR OVERCOMING THESE DEFECTS

To overcome the above defects, the light emitting apparatus of the present device comprises a plurality of conductors which are arranged in parallel, a plurality of multi-light emitting diodes, one terminal of each being connected to one of said conductors and the other terminal of each being connected to another conductor, where diodes are arranged at intervals in a longitudinal direction along the conductor, and insulating material covering the conductive portion of the multi-light emitting diodes and said conductor, thereby enabling the conductor to be conductive, and enabling light emission from the multi-light emitting diodes.

Figure 1:
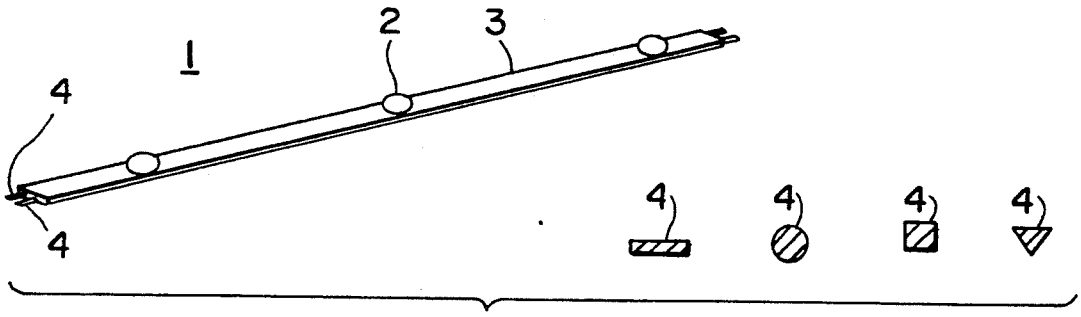
FIG. 1 is a drawing of a light emitting apparatus according to the embodiment of the present device.

In the drawings, 1 is a light emitting apparatus, 2 a multi-light emitting diode, 2-1 a light emitting diode element, 2—2 a protection diode, 2-3 a terminal, 3 an insulator, 4 a conductor, 5 a light emitting apparatus, 6 a light emitting tube or bulb, 7 a socket, 7-1 a terminal, 8 an externally attached resistor, 9 a neon lamp, 9-1 an electrode, 10 a white-heat filament electric bulb and 10-1 a filament.

EMBODIMENT

FIG. 1 shows an embodiment of the present device. FIG. 1 (*a*) represents a perspective drawing of the old device and FIGS. (*b*) to (*e*) show cross sectional shapes of conductors. In FIG. 1, 1 is a light emitting apparatus, 2 a multi-light emitting diode, 3 an insulator, and 4 a conductor. Conductors of various cross sections are possible. In addition to the tape-shaped conductor shown in FIG. 1 (*b*), cross sections may be circular, square or triangular, as shown in FIGS. (*c*) to (*e*). The conductor 4 is made thin or small in diameter for better flexibility, allowing it to be formed into various and small curves.

Multi-light emitting diodes 2 may be attached at predetermined intervals to an electric wire comprising an insulator 3 and a conductor 4. The intervals may be large or small and can be so small as to be almost continuous.

The multi-light emitting diode is formed by connecting several light emitting diode elements in series or in parallel, so that it can be molded integrally. The light emitting diode element, which is inherently mechanically strong and solid, is molded integrally to provide a multi-light emitting diode element which is inherently mechanically strong. As it is a semiconductor, its life is almost infinite.

Figure 2:
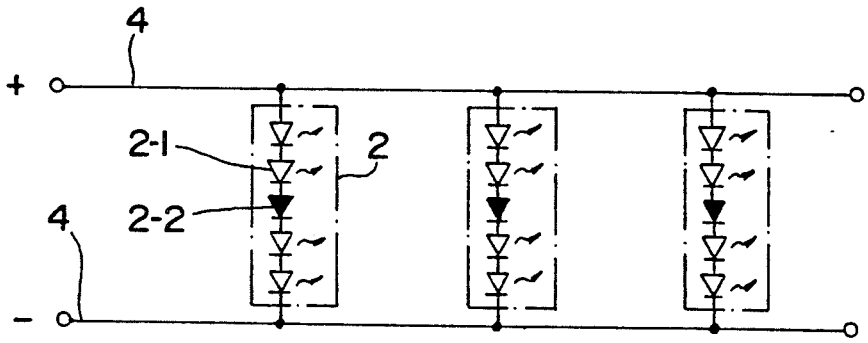
FIG. 2 shows a circuit diagram of an embodiment of the present device.
Figure 3:
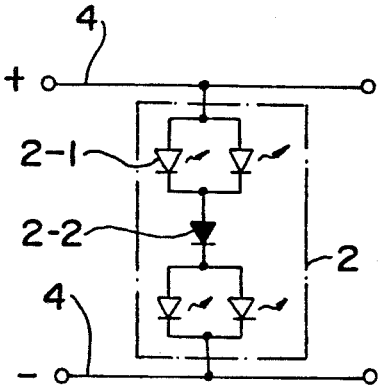
FIGS. 3 and 4 show other circuit diagrams of other multi-light emitting diodes used in the present device.
Figure 4:
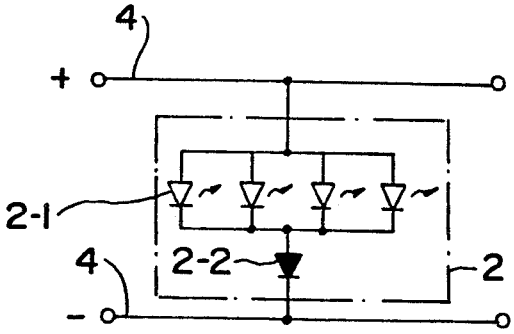

FIG. 2 is a circuit diagram of FIG. 1 and shows four light emitting diode elements 2-1 which are serially connected. 2—2 is a protective diode for protecting the light emitting diode elements 2-1 from an erroneous application of reverse polarity voltage. Therefore the protective diode 2—2 is not always necessary for light emitting and may be eliminated. The number of serially connected light emitting diode elements is not limited to four, and may be five or six. It is not limited to a series connection but may be applied to a combination of serial and parallel circuits as shown in FIG. 3, and may be applied to a parallel circuit as shown in FIG. 4. The multi-light emitting diode can provide a much more abundant amount of light than a light emitting diode formed by molding a single light emitting diode element, and the color thereof may be red, green, or white, or of various other kinds.

The conductors 4 may be arranged in parallel and multi-light emitting diodes 2 may be connected between two conductors 4. The number of conductors 4 may be three. In this case, the central conductor may be a common line and the multi-light emitting diode may be connected between the common line and one of the two conductors. Moreover, as can be seen in the drawings, the conductors 4 may be positioned close to each other, with the multi-light emitting diodes being provided on and between the conductors 4.

The parallel arrangement of conductors is not limited to a linear type, but may be curved in a circle or an 'S' shape or a spiral.

Figure 5:
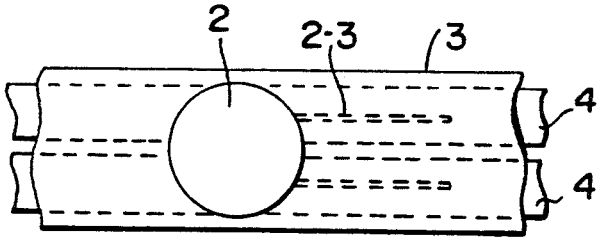
FIG. 5 is . . . an enlarged front view of an attaching portion of the multi-light emitting diode.
Figure 6:
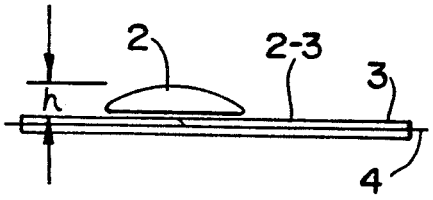
FIG. 6 is . . . a side cross-sectional view of the multi-light emitting diode.

FIG. 5 is an enlarged front view of a portion at which multi-light emitting diode 2 is attached to a tape-shaped electric wire. FIG. 6 is a side cross-sectional view thereof. 2-3 are terminals, 3 is an insulator, and 4 is a tape-shaped conductor. Terminals 2-3 are connected to tape-shaped conductor 4 by any well known proper method. The material of the insulator 3 for molding and covering the conductive portion is preferably flexible and may be transparent or may be colored. When it is attached in this way, the height H from the surface of tape-shaped electric wire of multi-light emitting diode 2 is very low, such as 2 or 3 mm.

Figure 7:
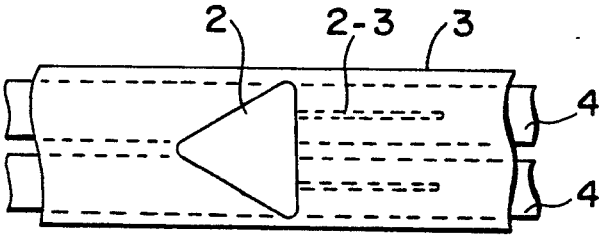
FIGS. 7, 8 and 9 . . . are examples of other shapes of a multi-light emitting diode for use in the present device.
Figure 8:
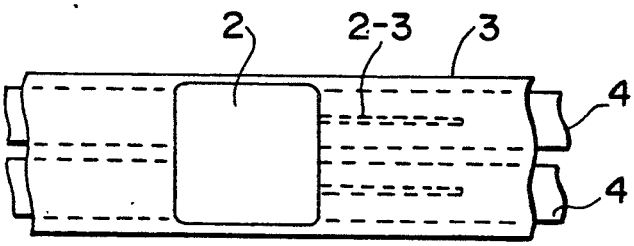
Figure 9:
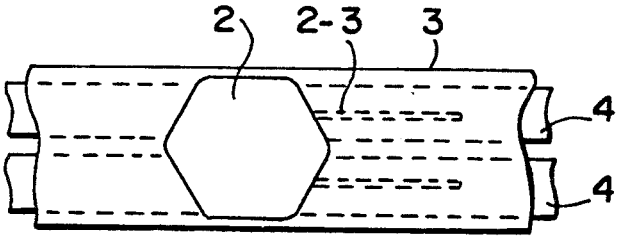
Figure 10:
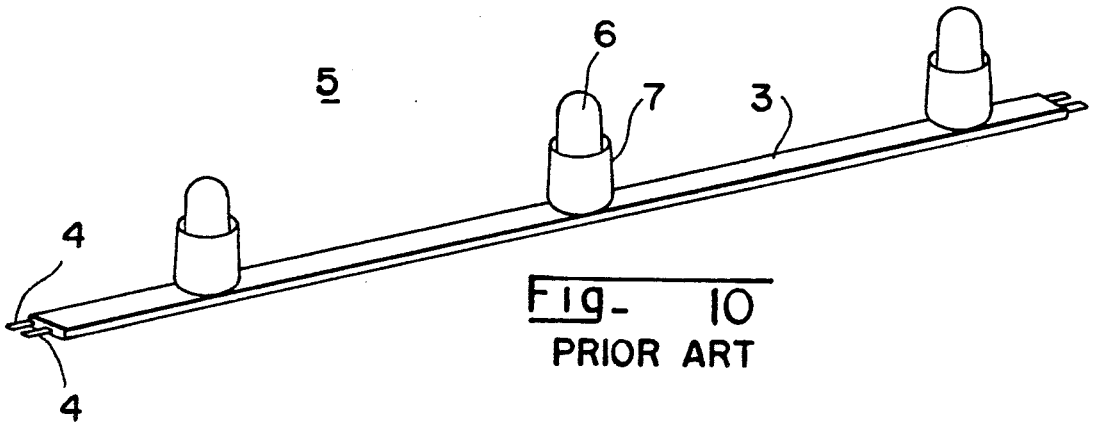
Fig- 10 PRIOR ART
FIG. 10 . . . perspective diagram of the conventional light emitting apparatus.
Figure 11:
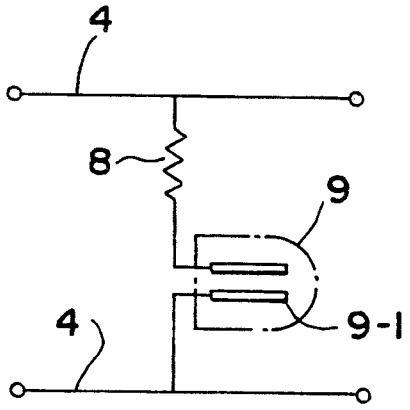
Fig- 11 PRIOR ART
FIG. 11 . . . a circuit in which a neon lamp is used for the light emitting element.
Figure 12:
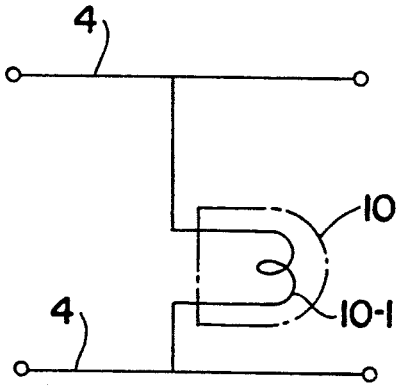
Fig- 12 PRIOR ART
FIG. 12 . . . a circuit in which a white heat filament electric bulb is used for the light emitting element.
Figure 13:
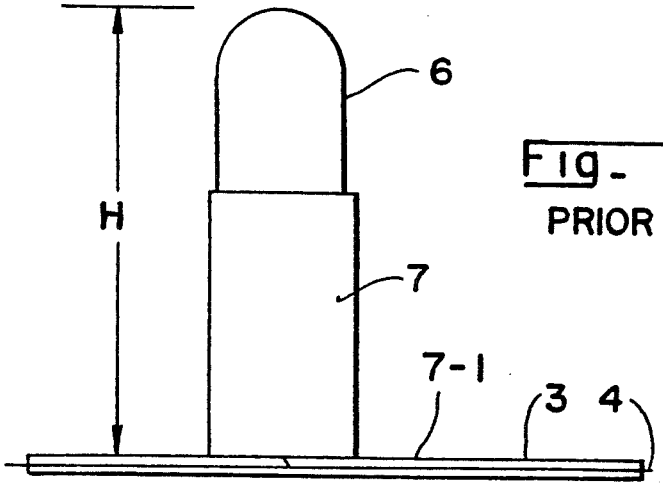
Fig- 13 PRIOR ART
FIG. 13 . . . a side view of an attaching portion of a light emitting element of a conventional light emitting apparatus.

FIGS. 7 to 9 show various examples of shapes of multi-light emitting diodes 2. For ornamental effect, it may be a desired shape, such as triangular, rectangular or hexagonal.

To enable light emitting apparatus 1 to emit light, conductor 4 passes an electric current in such a manner that a current flows in the forward direction of light emitting diode element 2-1. The light emitting diode element consumes a very small amount of electric power and operates at a low voltage. Therefore, a cell is sufficient for the power source. The power source voltage can be of various values such as 3 V, 6 V, 12 V, or 24 V, depending on the arrangement of light emitting diode elements. A voltage of about 100 V is used in some cases.

EFFECT OF THE DEVICE

According to the present device, as described above, the locations in which a light emitting apparatus can be provided are almost unlimited. A result is that it becomes applicable for uses which have not been considered at all in the prior art. This is the maximum result of the present device.

The light emitting portion is quite miniaturized, is mechanically strong, and its life is almost infinite. A safe and convenient, portable cell is sufficient for practical use as the power source, instead of a commercial source, and the cell can be applied to a moving vehicle or a person.

For example, the light emitting apparatus may be attached to any object, such as an automobile or bicycle, or to an ornament or a display. It can be attached to a helmet or working dress of a person working in a dark place at night, or used for a security display. In a party, discotheque or theater it can be attached to head, neck, hands, legs, or other parts of a person for the purpose of pleasure or theatrical effect. Therefore, the present device can develop a new use of electric light emitting apparatus which has not been previously considered at all.

Besides, as it is mechanically strong, its life is almost infinite, and as the height of the light emitting element is reduced, it has advantages in that security and maintenance thereof are easy, and it is compact and easy to handle.

What is claimed is:

1. A light emitting apparatus comprising at least two conductors arranged in parallel, a plurality of illuminating units comprising multi-light emitting diodes, said illuminating units having at least two terminals, and provided on and between said at least two conductors, one terminal of each of said illuminating units being connected to one of said at least two conductors, and another terminal of each of said illuminating units being connected to another of said at least two conductors, and said multi-light emitting diodes connecting each light emitting diode in series or in parallel and being provided on and between said two terminals, and said illuminating units being spaced apart in a longitudinal direction of said at least two conductors, and a flexible insulator formed by insulating conductive portions of said illuminating units and said at least two conductors, thereby enabling an electric current to pass through said at least two conductors, and enabling said illuminating units to emit light.

2. The light emitting apparatus according to claim 1, wherein said at least two conductors are tape-shaped.

3. The light emitting apparatus according to claim 1, wherein said at least two conductors are positioned close to each other, and said illuminating units are provided on and between said at least two conductors.

4. A light emitting apparatus comprising at least two conductors arranged in parallel, a plurality of illuminating units comprising multi-light emitting diodes, said illuminating units having at least two terminals, and provided on and between said at least two conductors, one terminal of each of said illuminating units being connected to one of said at least two conductors, and another terminal of each of said illuminating units being connected to another of said at least two conductors, and said multi-light emitting diodes connecting each light emitting diode in series or in parallel and being provided on and between said two terminals, and said illuminating units being spaced apart in a longitudinal direction of said at least two conductors, a flexible insulator formed by insulating conductive portions of said illuminating units and said at least two conductors, thereby enabling an electric current to pass through said at least two conductors, and enabling said illuminating units to emit light, and wherein said multi-light emitting diodes are connected in series with a protective diode protecting the multi-light emitting diodes from reverse polarity voltage.

5. The light emitting apparatus according to claim 4, wherein said at least two conductors are tape-shaped.

6. A method of placing a light emitting apparatus on an object comprising obtaining a light emitting apparatus, said light emitting apparatus comprising at least two conductors arranged in parallel; a plurality of illuminating units comprising multi-light emitting diodes, said illuminating units having at least two terminals, and provided on and between said at least two conductors, one terminal of each of said illuminating units being connected to one of said at least two conductors and another terminal of each of said illuminating units being connected to another of said at least two conductors, and said multi-light emitting diodes connecting each light emitting diode in series or in parallel and being provided on and between said two terminals, and said illuminating units being spaced apart in a longitudinal direction of said at least two conductors; and a flexible insulator formed by insulating conductive portions of said illuminating units and said at least two conductors, thereby enabling an electric current to pass through said at least two conductors, and enabling said illuminating units to emit light, and placing said light emitting device on said object.

7. The method of placing a light emitting apparatus on an object according to claim 6, wherein said at least two conductors are positioned close to each other, and said illuminating units are provided on and between said at least two conductors.

* * * * *

UNITED STATES PATENT AND TRADEMARK OFFICE

CERTIFICATE OF CORRECTION

PATENT NO. : 5,155,669
DATED : October 13, 1992
INVENTOR(S) : Y. YAMURO

It is certified that error appears in the above-indentified patent and that said Letters Patent is hereby corrected as shown below:

Title page, item [30]
"Foreign Application Priority Data", line 1. insert ---September 25, 1986 Japan 61-147036[U]---.

Title page, item [57]
Abstract, line 5, change "conected" to ---connected---.

Signed and Sealed this
Twenty-sixth Day of November 1996

*Attest:*

*Attesting Officer*

BRUCE LEHMAN

*Commissioner of Patents and Trademarks*